US005907308A

United States Patent [19]

Oka et al.

[11] Patent Number: 5,907,308

[45] Date of Patent: May 25, 1999

[54] WINDOW GLASS ANTENNA SYSTEM

[75] Inventors: Hidetoshi Oka; Yoshinori Matsuoka, both of Osaka; Hideaki Tanaka; Yasuyuki Takano, both of Toyota, all of Japan

[73] Assignee: Nippon Sheet Glass Co., Ltd., Japan

[21] Appl. No.: 08/857,192

[22] Filed: May 15, 1997

[30] Foreign Application Priority Data

May 16, 1996 [JP] Japan ..... 8-122024

[51] Int. Cl.[6] ..... H01Q 1/32

[52] U.S. Cl. ..... 343/713; 343/860

[58] Field of Search ..... 343/713, 860

[56] References Cited

U.S. PATENT DOCUMENTS

| | | | |
|---|---|---|---|
| 5,239,302 | 8/1993 | Maeda et al. | 343/860 |
| 5,334,988 | 8/1994 | Murakami et al. | 343/713 |
| 5,654,721 | 8/1997 | Saitou et al. | 343/713 |
| 5,719,585 | 2/1998 | Tabata et al. | 343/173 |

FOREIGN PATENT DOCUMENTS 7-22892 5/1995 Japan .

*Primary Examiner*—Don Wong
*Assistant Examiner*—Hoang Nguyen
*Attorney, Agent, or Firm*—Adams & Wilks

[57] ABSTRACT

A window glass antenna system includes a defogging heater pattern disposed on a window glass pane and being operable also as an AM broadcast receiver antenna, an impedance matching circuit having two inductors for respectively causing series resonance and parallel resonance of AM broadcast signals fed from an output of the heater pattern and being designed to supply the AM broadcast signals to an associated radio receiver, and at least one capacitor disposed between the heater pattern output and the impedance matching circuit for blocking induced noises of AM frequency band. With this arrangement, it becomes possible to significantly attenuate noises of AM frequency band to be induced into the heater pattern, without attenuating received signals of AM broadcast, whereby AM broadcast radio reception of good S/N ratio is enabled.

21 Claims, 10 Drawing Sheets

| | C1 [pF] | NOISE VOLTAGE | AM FREQUENCY BAND OUTPUT VOLTAGE |
|---|---|---|---|
| CASE 1 | 1000 | 0dB | 0dB |
| CASE 2 | 560 | −20dB | −0.8dB |
| CASE 3 | 330 | −25dB | −1.2dB |
| CASE 4 | 220 | −30dB | −1.9dB |

WINDOW GLASS ANTENNA SYSTEM

BACKGROUND OF THE INVENTION

1. Field of the Invention

This invention relates generally to a window glass antenna system for receiving radiowaves of AM (Amplitude Modulation) and FM (Frequency Modulation) bands and, in particular, to a window glass antenna system in which a noise blocking circuit is provided for reducing noises from an antenna of the system.

2. Description of the Related Art

An example window glass antenna system is disclosed in Japanese Utility Model Kokoku (Post-Exam) Publication No. HEI 7-22892 and U.S. Pat. No. 5,239,302 of the present assignee. This prior window antenna system includes an impedance matching circuit provided between a window glass antenna for receiving AM band radiowaves and a feeder cable connected to a radio receiver. The impedance matching circuit may be caused to undergo series resonance and parallel resonance by frequencies of AM band radiowaves received by the window glass antenna to thereby increase the reception level of AM radio reception signals fed to the radio receiver.

Reference is made to FIG. 12 hereof which shows the general arrangement of the known window glass antenna system.

As shown in FIG. 12, the window glass antenna system 50 has upper and lower heater patterns 52 and bus bars 53, 54, 55, which are deposited on an area of a rear window glass (pane) 51 where defogging is required. The upper and lower heater patterns 52 are all connected at one end through the bus bar 55 and fed with power via the bus bars 53, 54 at opposite ends thereof.

Heating of the upper and lower heater patterns is achieved by supplying an electrical current from a power source +B through a wire harness 62W, through a choke coil 61A, through a feeder 62, through the bus bar 53, through the lower heater pattern 52, through the bus bar 55, through the upper heater pattern 52, through the bus bar 54, through a feeder 63 and through a choke coil 61B and then to ground.

Choke coils 61A, 61B are set to have a high impedance relative to the AM band frequencies as viewed at the power source +B from the bus bars 53, 54 so that the heater patterns 52 can be used as antennas. The choke coils 61A, 61B are also set to have a high impedance as viewed at the bus bars 53, 54 from the power source +B so that AM radio frequency band noises arising from the power source side can be reduced.

Decoupling capacitor 64 is provided to block power source noises to be induced from the power source +B into the heater patterns 52 forming an AM antenna.

AM band radio reception signals are supplied via an output 56 of the bus bar 55 to an impedance matching circuit 65. The matching circuit 65 is composed of inductors and a resistor and has an inductance value which is selected so that impedance as viewed from an input terminal 66A of the radio receiver (not shown) causes series resonance and parallel resonance in AM band frequencies to thereby increase the level of the AM band radio reception signals of the input terminal 66A. Designated by reference numerals 65A, 65B are input and output terminals of the matching circuit 65.

Shown in FIG. 13 is an equivalent circuit diagram of the known window glass antenna system. In this figure, reference character Eo represents an induced voltage of AM radio frequency band generated in the heater patterns (antenna) 52. Reference characters $R_A$, $C_A$ and $C_B$ respectively represent equivalent resistance, equivalent capacitance and stray capacitance of the heater patterns (antenna) 52. Designated by reference character $C_L$ is stray capacitance of feeders 62, 63. $R_L$, $C_D$ and $L_X$ represent equivalent resistance, equivalent capacitance and equivalent inductance of the choke coils 61A, 61B, respectively. $C_K$ designates stray capacitance of a feeder cable 57.

Matching circuit 65 is composed of an inductor $L_A$, inductor $L_B$ and a resistor R. The inductor $L_A$ is connected in series with the antenna stray capacitance (combined capacitance) as viewed at the antenna from the radio receiver input 66A whilst the inductor $L_B$ is connected in parallel with the antenna stray capacitance (combined capacitance) as viewed at the antenna from the radio receiver input 66A. Thus, in the AM radio frequency band, inductor $L_A$ and stray capacitance (combined capacitance) jointly cause series resonance while inductor $L_B$ and stray capacitance (combined capacitance) jointly cause parallel resonance. As a result, the AM radio frequency band reception signals received by the antenna can be increased in level and supplied to the radio receiver, whereby improvement in the reception sensitivity relative to the AM radio frequency band is achieved.

However, in the known window glass antenna system 50, when noises are induced into the wire harness 62W connecting the power source +B and choke coil 61A, the noises may not be fully attenuated in the choke coil 61A and may thus be partially fed into the heater patterns 52 forming the AM antenna. As a result, the noises are eventually received by the radio receiver through the matching circuit 65, thus presenting the AM broadcast with such noises and leading to the deterioration of the quality of the resulting antenna system.

When noises of the order of 100–200 kHz are induced into the wire harness 62W from various electrical parts such as a stop (brake) light and a direction indicator (blinker), or from an alternator, noise components are generated in the AM broadcast frequency band of 522–1620 kHz through cross modulation within the radio, thus deteriorating the SIN (signal-to-noise) ratio.

One may propose the approach to establish high impedance relative to noise frequencies by increasing inductance of the choke coils 61A, 61B to thereby reduce noises to be induced into the AM antenna to such an extent that they pose no problems in practical uses. However, this results in large-sizing of the choke coils and hence is costly and impractical.

SUMMARY OF THE INVENTION

It is therefore an object of the present invention to provide a window glass antenna system in which the foregoing problems are obviated.

According to the present invention, there is provided a window glass antenna system which comprises: a heater pattern disposed on a pane of window glass and designed to defog the window glass pane and to also operate as an AM broadcast receiver antenna; an impedance matching circuit disposed externally of the window glass pane and connected to the heater pattern, the impedance matching circuit having an inductor for causing series resonance of AM broadcast signals fed from a first output of the heater pattern and a second inductor for causing parallel resonance of the AM broadcast signals output from the heater pattern and being designed to supply the AM broadcast signals to an associated radio receiver; and at least one capacitor disposed between the heater pattern output and the impedance matching circuit for blocking induced noises of AM frequency band.

Since the capacitor significantly reduces noises introduced from various electrical parts such as a stop light and a blinker, or noises of AM broadcast frequency band such as those from an alternator, reception of AM broadcast of appropriate S/N ratio is enabled.

Additional objects, advantages and features of the present invention will become apparent from the following description and appended claims, taken in conjunction with the accompanying drawings.

DETAILED DESCRIPTION OF THE PREFERRED EMBODIMENTS

Preferred embodiments of the present invention will now be described in detail with reference to the accompanying drawings.

Figure 1:
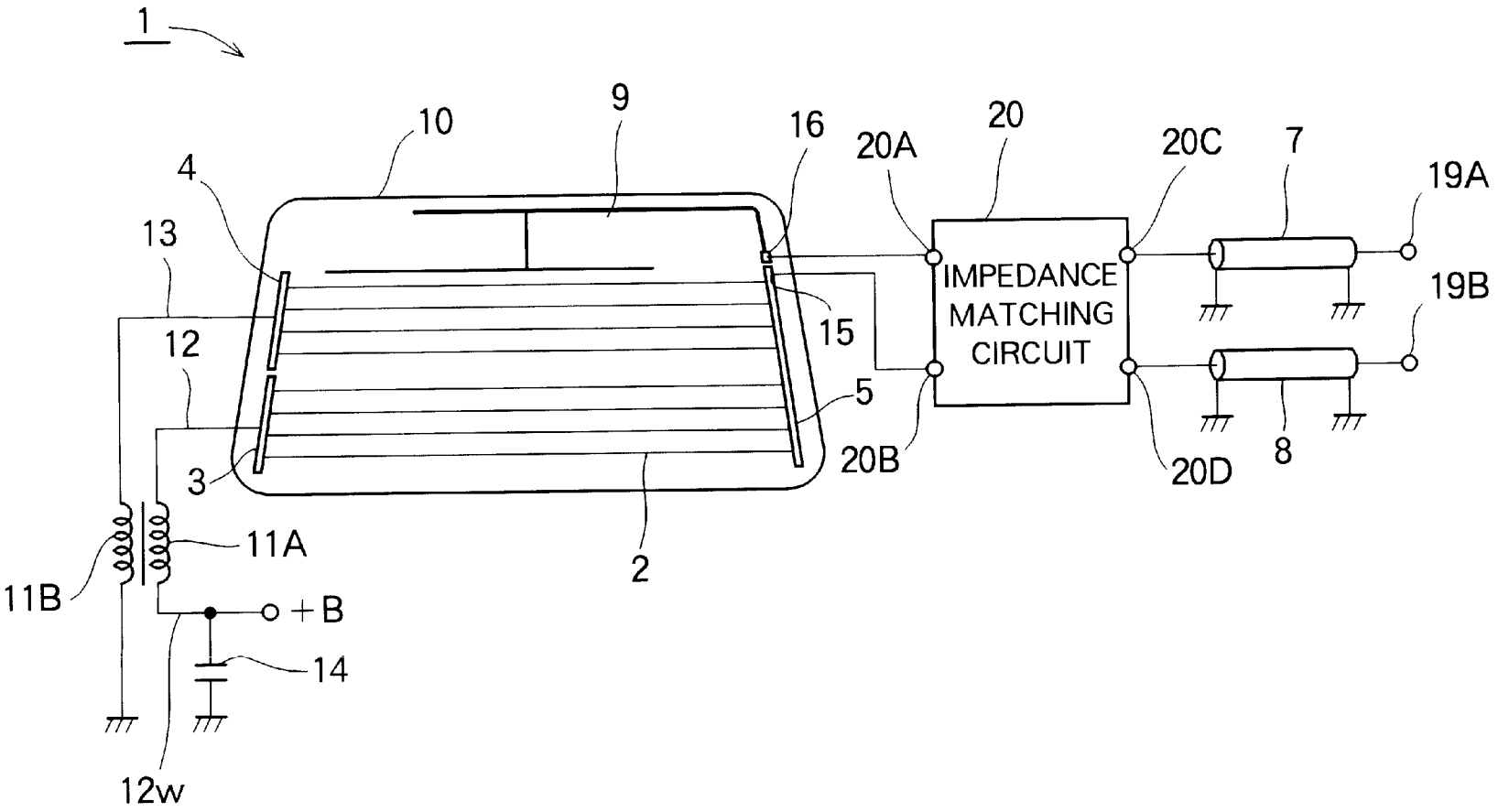
FIG. 1 is a schematic view illustrating the general arrangement of a window glass antenna system according to one embodiment of the present invention.

Referring to FIG. 1, a window glass antenna system according to an embodiment of the present invention, generally designated by reference numeral 1, is shown schematically.

Window glass antenna system 1 is comprised of conductive defogging heater patterns 2, bus bars 3, 4, 5, and main antenna pattern 9 for the reception of FM broadcast, which are disposed on a pane of rear window glass 10 by deposition or any other similar methods. The heater patters 2 also serve as an AM/FM sub-antenna.

In the window glass antenna system 1, electrical current is supplied from a power source +B, through choke coils 11A, 11B, bus bars 3, 4, to the heater patterns 2 for heating thereof.

To use the heater patterns 2 as an antenna for receiving AM/FM broadcast radiowaves, the choke coils 11A, 11B are set to have high impedance relative to the AM/FM band frequencies as viewed at the power source +B from the bus bars 3, 4.

Also, the choke coils 11A, 11B are set to have high impedance as viewed at the bus bars 3, 4 from the power source +B so as to reduce noises of AM radio frequency band to be induced from the power source +B.

Decoupling capacitor 14 is designed to block power source noises of relatively high frequency induced by the power source +B from entering into the defogging-heater patterns 2 forming the AM/FM antenna.

On the bus bar 5, there is provided an antenna output terminal 15 of the AM/FM broadcast receiving antenna (heater patters 2). Similarly, on the main antenna pattern 9 for receiving FM broadcast, there is provided an antenna output terminal 16. These output terminals 15, 16 are respectively connected to input terminals 20A, 20B of an impedance matching circuit 20.

Received AM/FM broadcast signals are fed to a radio receiver (not shown) from the output terminals 20C, 20D of the impedance matching circuit 20 through outputs 19A, 19B of coaxial feeder cables 7, 8.

Output 19A of the feeder cable 7 is a main output terminal for the received signals of AM broadcast and FM broadcast while the output 19B of the feeder cable 8 is a sub-output terminal for the received signals of FM broadcast.

Figure 2:
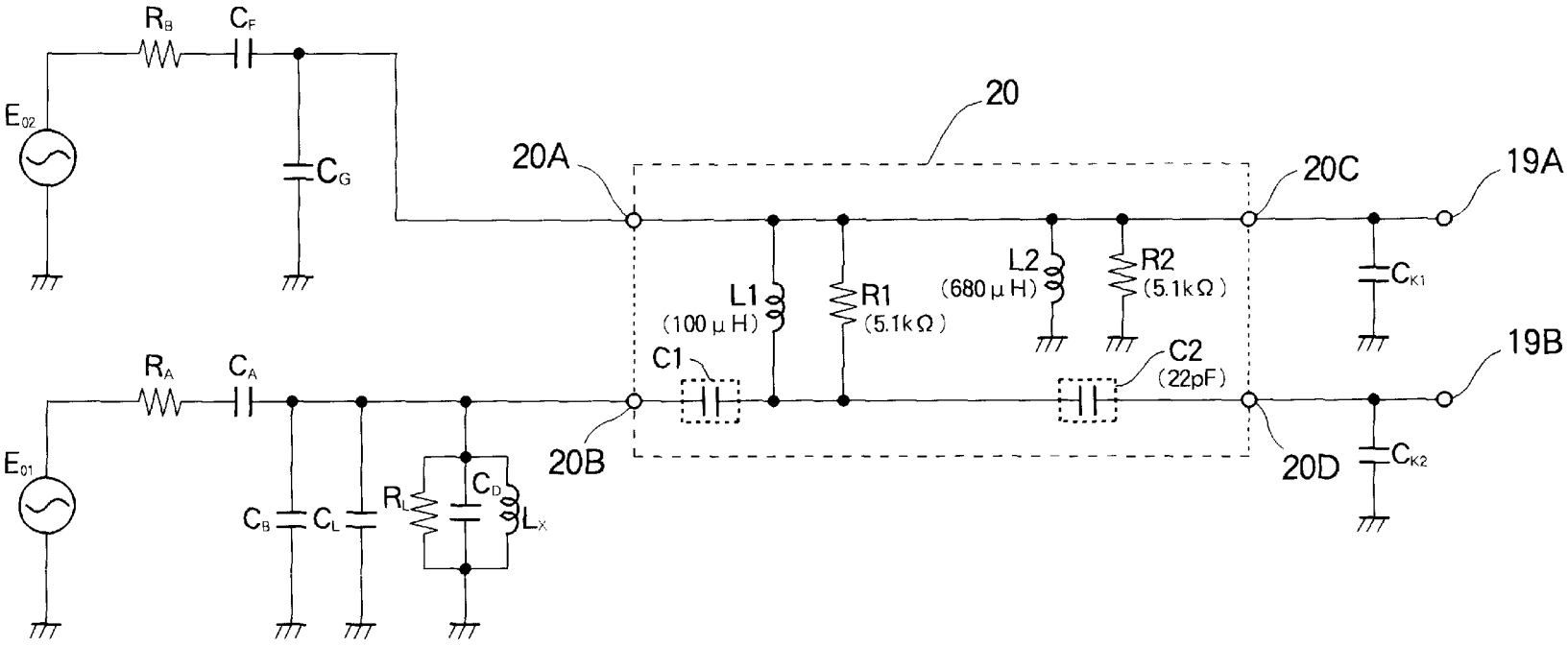
FIG. 2 is a circuit diagram showing an equivalent circuit of the window glass antenna system.
Figure 3:
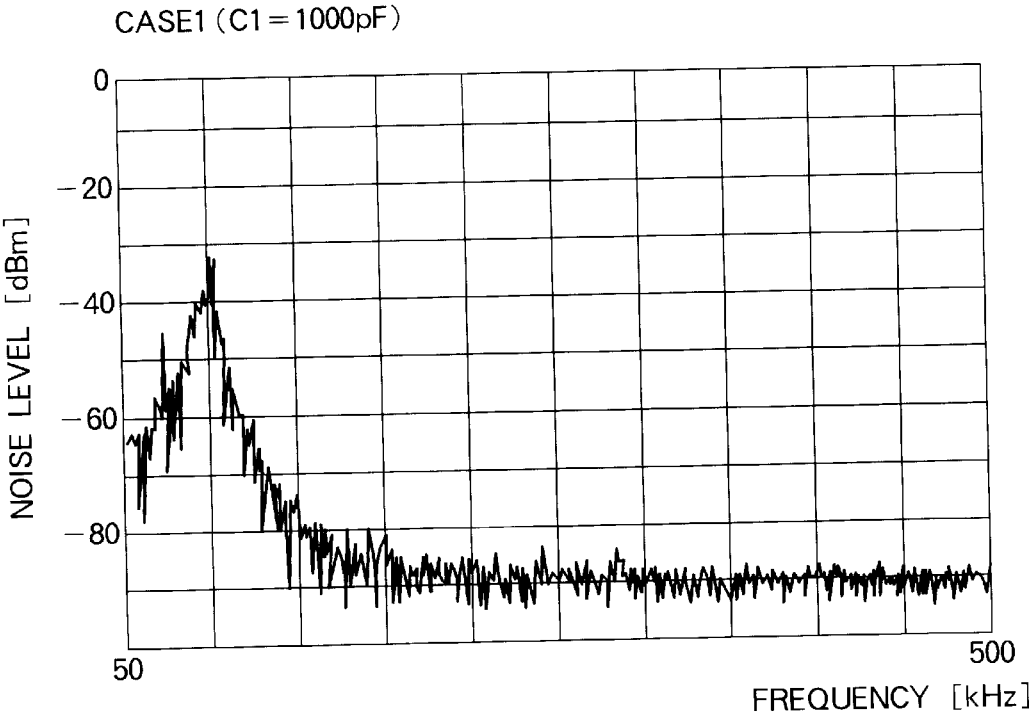
FIG. 3 is a graph (case 1) illustrating the noise frequency characteristics of a radio receiver input terminal of the window glass antenna system.
Figure 4:
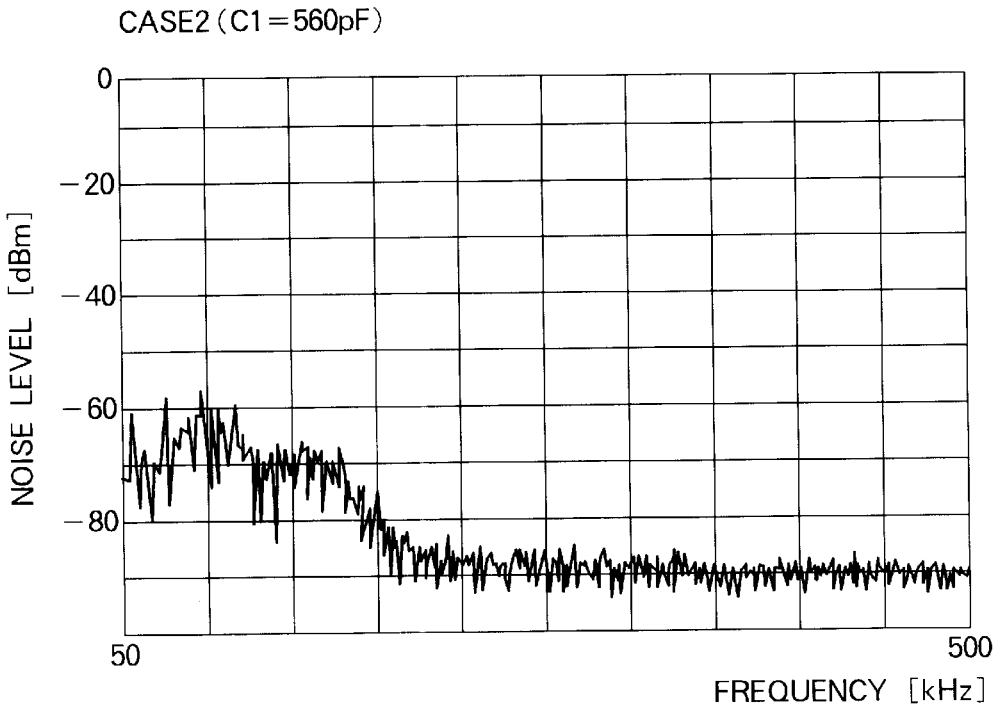
FIG. 4 is a graph (case 2) illustrating the noise level frequency characteristics of the radio receiver input terminal of the window glass antenna system.
Figure 5:
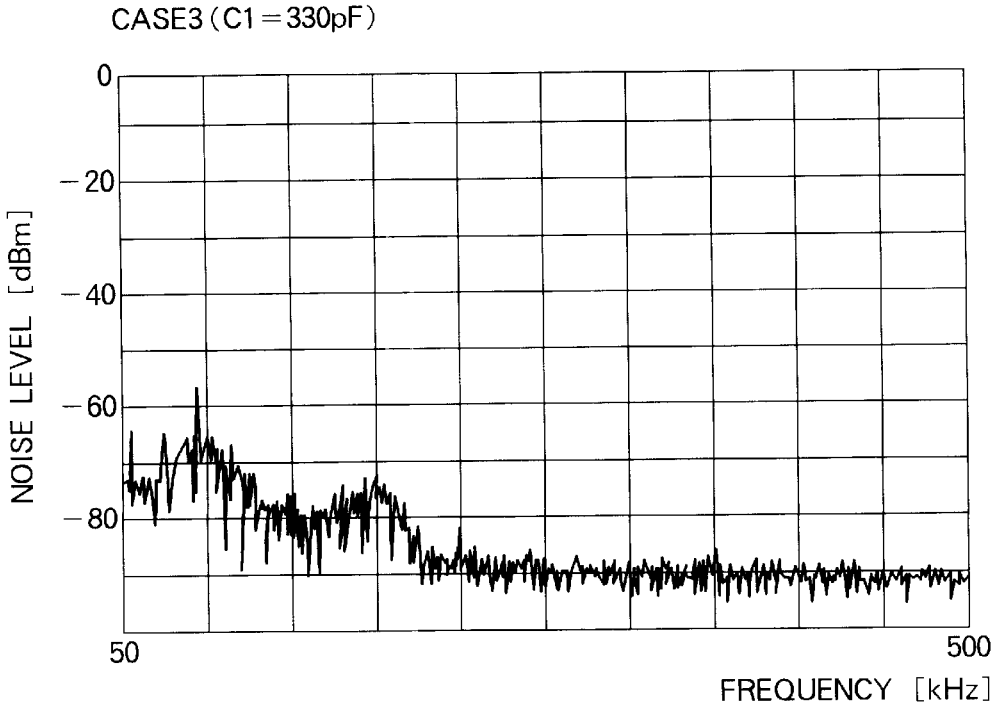
FIG. 5 is a graph (case 3) illustration the noise level frequency characteristics of the radio receiver input terminal of the window glass antenna system.

Reference is now made to FIG. 2 which shows an equivalent circuit of the window glass antenna system according to the present invention.

In FIG. 2, reference character E01 designates a voltage of AM/FM radio frequency band to be induced into the defogging-heater patterns (AM/FM antenna) 2. Designated by reference characters $R_A$, $C_A$ and $C_B$ are equivalent resistance, equivalent capacitance and stray capacitance of the heater patterns 2. $C_L$ designates stray capacitance of feeders 12, 13. Designated by $R_L$, $C_D$ and $L_X$ are equivalent resistance, equivalent capacitance and equivalent inductance of the choke coils 11A, 11B.

Reference character $E_O$2 represents a voltage of FM radio frequency band to be induced into the FM main antenna pattern 9. $R_B$, $C_F$ and $C_G$ respectively designate equivalent resistance, equivalent capacitance and stray capacitance of the main antenna pattern (FM antenna) 9.

$C_K$1 designates stray capacitance of the feeder cable 7 while $C_K$2 designates stray capacitance of the feeder cable 8.

Impedance matching circuit 20 includes of a four terminal network comprised of a passive element with a resistor, inductor and capacitor. A parallel circuit having an inductor L1 and a resistor R1, and a capacitor C1 are connected in series between the inputs 20A, 20B. Between the input terminal 20B and output terminal 20D, the capacitor C1 and capacitor C2 are connected in series.

Further, in the impedance matching circuit 20, the input terminal 20A and output terminal 20C are shorted. An inductor L2 and resistor R2 are connected in series between the output terminal 20C and ground.

In the thus arranged impedance matching circuit 20, the inductor L1 forms a series resonance circuit in the frequency band of AM broadcast jointly with the resistors $R_A$, $R_L$, capacitors $C_A$, $C_L$, $C_D$, $C_F$, $C_K$1 and inductor $L_X$ as viewed from the output 19A of the feeder cable 7.

Similarly, the inductor L2 forms a parallel resonance circuit in the frequency band of AM broadcast jointly with the resistors $R_A$, $R_L$, capacitors $C_A$, $C_L$, $C_D$, $C_F$, $_C$K1 and inductor $L_X$ as viewed from the output 19A of the feeder cable 7.

By appropriately setting values of the inductor L1 and inductor L2, it becomes possible to increase the level of the reception signals of AM broadcast at the output 19A of the feeder cable 7 through the action of series resonance and parallel resonance in the frequency band of AM broadcast.

Resistors R1 and R2 may be damping resistors for suppressing the peak values of the respective series resonance and parallel resonance and minimizing the difference between the levels of the received signals in the AM frequency band at the output 19A of the feeder cable 7.

Capacitor C1 allows passage of AM/FM broadcast signals received by the heater patterns (AM/FM antenna) 2 and supplied through the input terminal 20B without attenuating the signals, and significantly attenuates the noise level of AM frequency band to be supplied from the input terminal 20B.

By contrast, the capacitor C2 allows passage of only the received FM broadcast signals among the AM/FM broadcast signals supplied through the input terminal 20B and capacitor C1, while blocking passage of the AM broadcast signals. The FM broadcast signals are then fed to the output 19B of the feeder cable 8.

As can be appreciated from the foregoing description, the impedance matching circuit 20 is thus capable of supplying AM broadcast signals of large reception signal level, sufficiently attenuated in the noise level, to the output 19A of the feeder cable 7 by appropriately setting the values of the passive network components such as the inductors L1, L2, resistors R1, R2, and capacitors C1, C2 forming the circuit.

Based on experiments conducted to determine practical values of the reception signal level of AM broadcast at the output 19A of the feeder cable 8, discussion will be made next as to the noise level of the impedance matching circuit 20 when the inductor L1 is set at 100 $\mu$H, inductor L2 is set at 680 $\mu$H, resistors R1, R2 are set at 5.1 kΩ, capacitor C2 is set at 22 pF, and the value of the capacitor C1 is varied. Relatedly, it should be noted that the choke coils 11A, 11B of FIG. 1 has inductance of 1.4 mH.

Reference is made to FIG. 3 to FIG. 6 which illustrate noise frequency characteristics (cases 1–4) of the input terminal of the radio receiver associated with the window glass antenna system according to the present invention. The characteristics of FIG. 3 to FIG. 6 are the results of measurement carried out with the capacitor C1 set at 1000 pF, 560 pF, 330 pF and 220 pF under noise generation conditions wherein a DEF (defogger) switch is put on, a headlight is set on main beam, and an engine is operated at 3500 rpm.

By reducing the value of the capacitor C1 from 1000 pF (FIG. 3: case 1) to 220 pF (FIG. 6: case 4), the noise level drops.

Figures 6, 7:
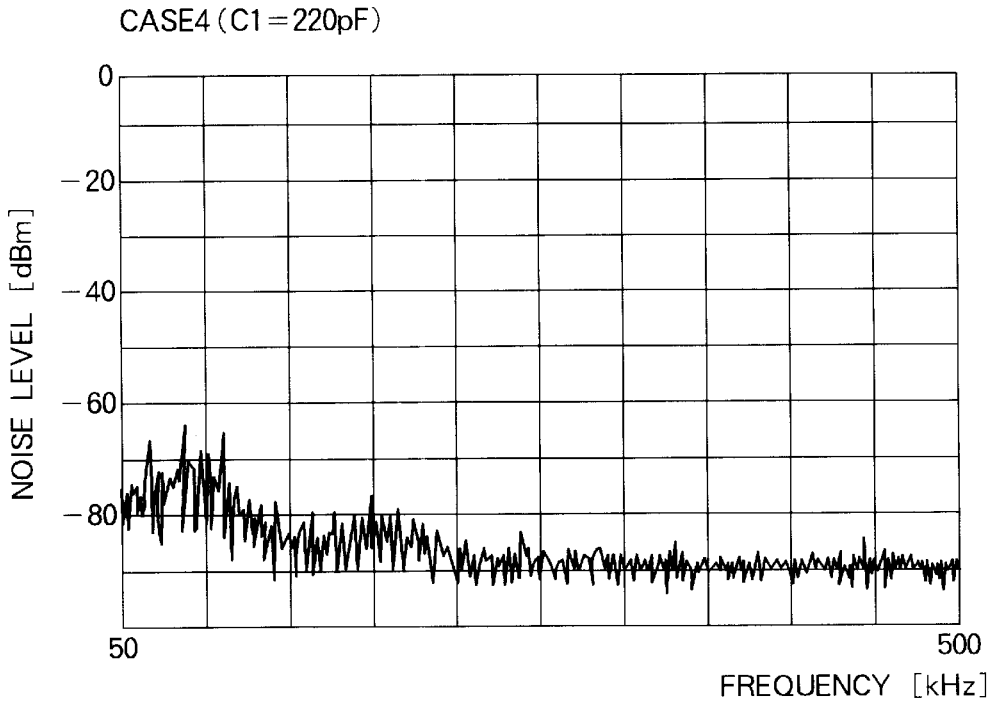
FIG. 6 is a graph (case 4) illustrating the noise level frequency characteristics of the radio receiver input terminal of the window glass antenna system.
FIG. 7 shows comparative data between the noise voltages of cases 1–4 and output voltages of the AM reception signals.

Next, reference is made to FIG. 7 which shows comparisons between the noise voltages of cases 1–4 and output voltages of AM reception signals.

In FIG. 7, the noise voltages and AM frequency band output voltages (output voltages of AM reception signals) are given using case 1 as a reference (0 dB) wherein the capacitor C1 has the value of 1000 pF.

Upon varying the value of the capacitor C1 from 1000 pF to 220 pF, the noise voltage dropped by 30 dB (3.1%) while the attenuation of the AM frequency band output voltages was 1.9 dB at the most. It is thus made possible to significantly improve the S/N ratio of the AM broadcast reception signals at the output 19A of the feeder cable 7.

It should also be appreciated that the capacitor C1 set at 560 pF can also attenuate the noise voltages by 20 dB (10 %), which is useful for practical purposes. With the attenuation of the output voltages of AM frequency band in view, the value of the capacitor C1 may desirably be set at 220 pF–560 pF.

As explained above, the window glass antenna system 1 according to the present invention is comprised of the impedance matching circuit 20 having the capacitor C1. As a result, it becomes possible to significantly attenuate the noise level to be generated in the AM frequency band, without lowering the signal level of the received signals of AM broadcast, while significantly improving the S/N ratio of the received signals of AM broadcast.

Discussion will now be made as to a window glass antenna system according to a separate embodiment of the present invention, having reference to FIG. 8.

Figure 8:
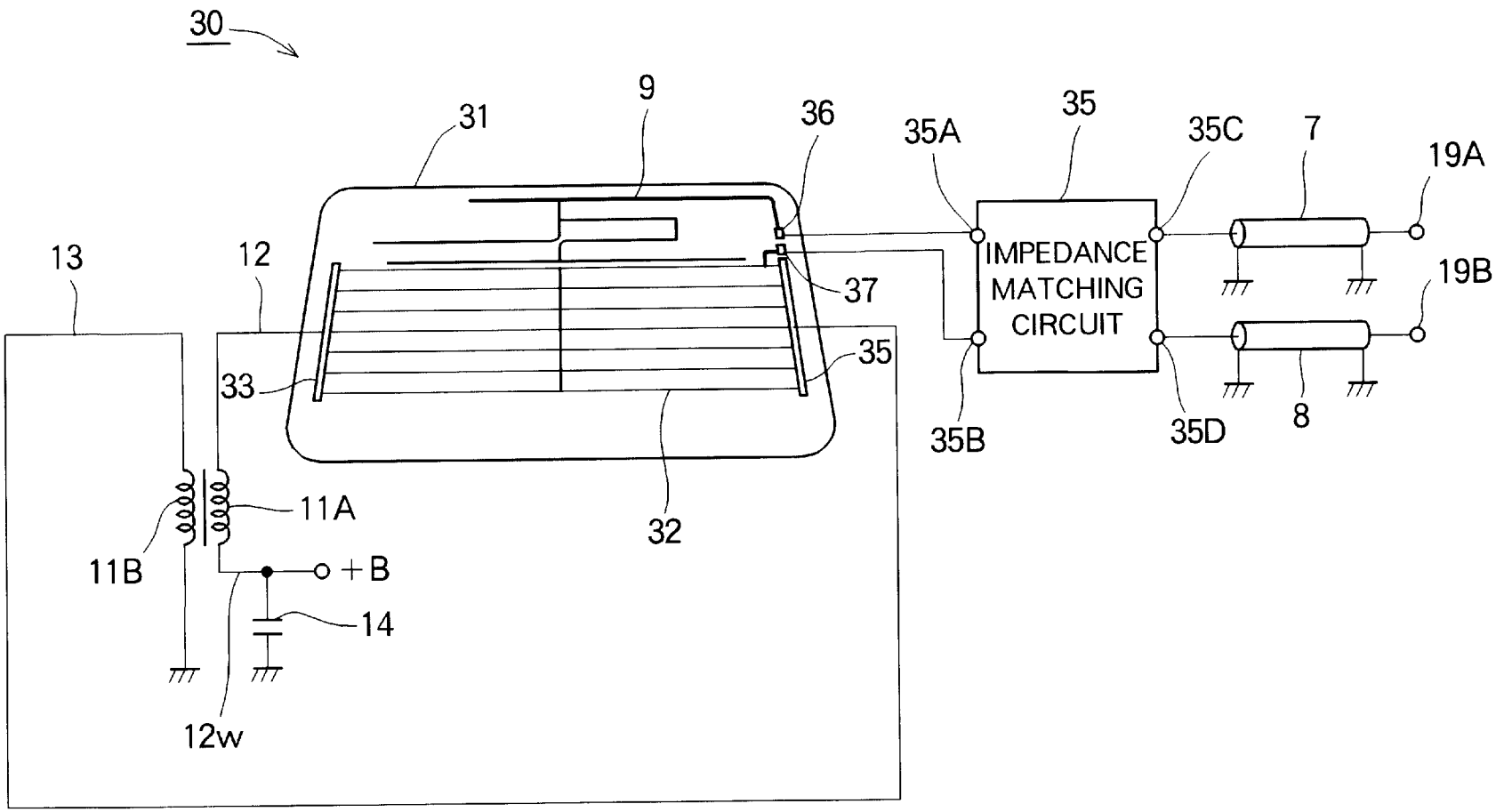
FIG. 8 is a schematic view illustrating the general arrangement of a window glass antenna system according to a separate embodiment of the present invention.

As can be appreciated from FIG. 8, the window glass antenna system, generally designated by reference numeral 30, differs from the window glass antenna system of FIG. 1 only in that defogging heater patterns 32 disposed on a rear window glass 31 by deposition or the like method are shaped differently and bus bars 33, 35 for supplying an electrical current to the heater pattern 32 for heating thereof are differently constructed. The heater pattern 32 operates as an AM/FM antenna while an FM antenna pattern 9 operates exclusively as an FM antenna, like those of the window glass antenna system of FIG. 1.

Figure 9:
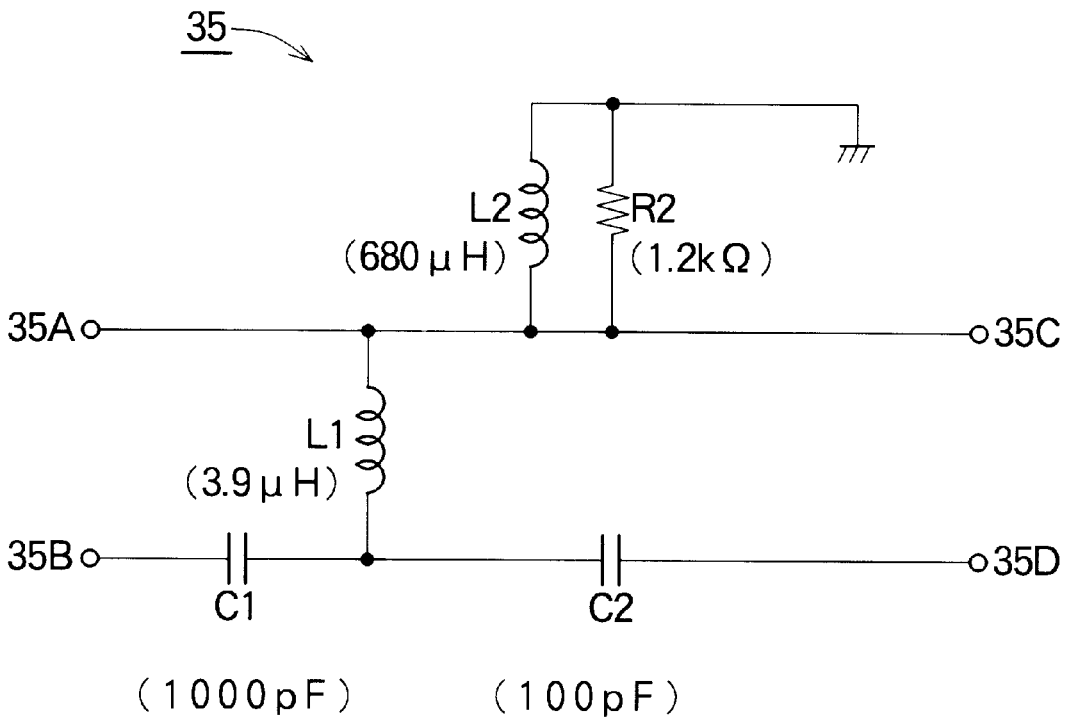
FIG. 9 is a circuit diagram of an impedance matching circuit of the window glass antenna system according to the separate embodiment of the present invention.

Impedance matching circuit 35 is identical in construction to the impedance circuit of FIG. 2 except that the resistor R1 as found in the impedance matching circuit of FIG. 2 is not present, as can be appreciated from FIG. 9, and that a passive element has values different from those of the passive element of FIG. 2. In the impedance matching circuit 35, inductor L1 is set at 3.9 $\mu$H while inductor L2 is set to be 680 $\mu$H. Resistor R2 is set to be 1.2 KΩ. The value of capacitor C1 is 1000 pF while the value of capacitor C2 is 100 pF. Inductance of choke coils 11A, 11B is 1.4 mH.

Figure 10:
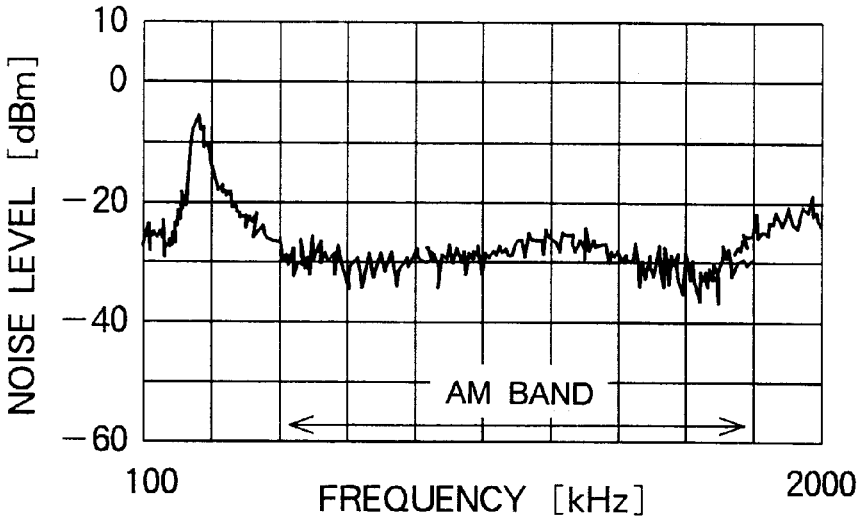
FIG. 10 is a graph illustrating the noise level frequency characteristics (C1=1000 pF) of a radio receiver input terminal of the window glass antenna system according to the separate embodiment of the present invention.

FIG. 10 illustrates noise level frequency characteristics (C1=1000 pF) of an input terminal of a radio receiver (not shown) associated with the window glass antenna system according to the separate embodiment of the present invention.

As seen from the characteristics of FIG. 10, when the impedance matching circuit 35 of FIG. 9 is used, there appears a high noise level (noise level-5 dBm) in the vicinity of the frequency of 200 KHz.

Figure 11:
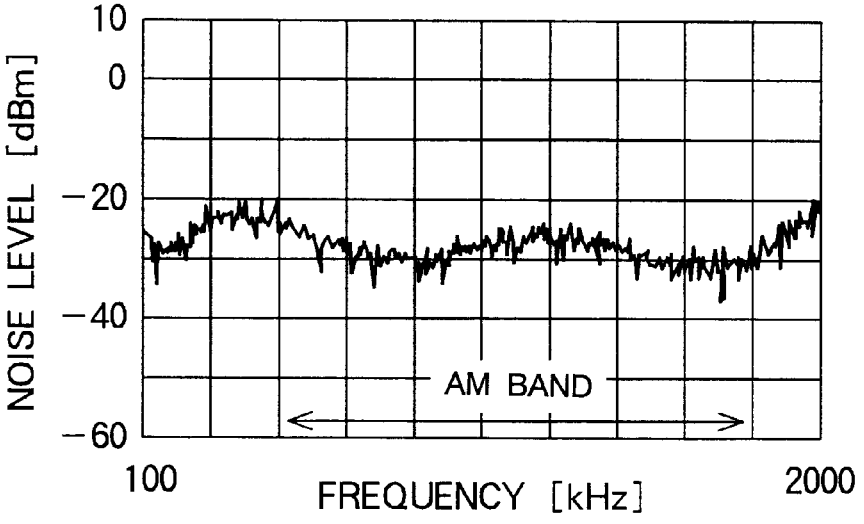
FIG. 11 is a graph illustrating the noise level frequency characteristics (C1=220 pF) of the radio receiver input terminal of the window glass antenna system according to the separate embodiment of the present invention.
Figure 12:
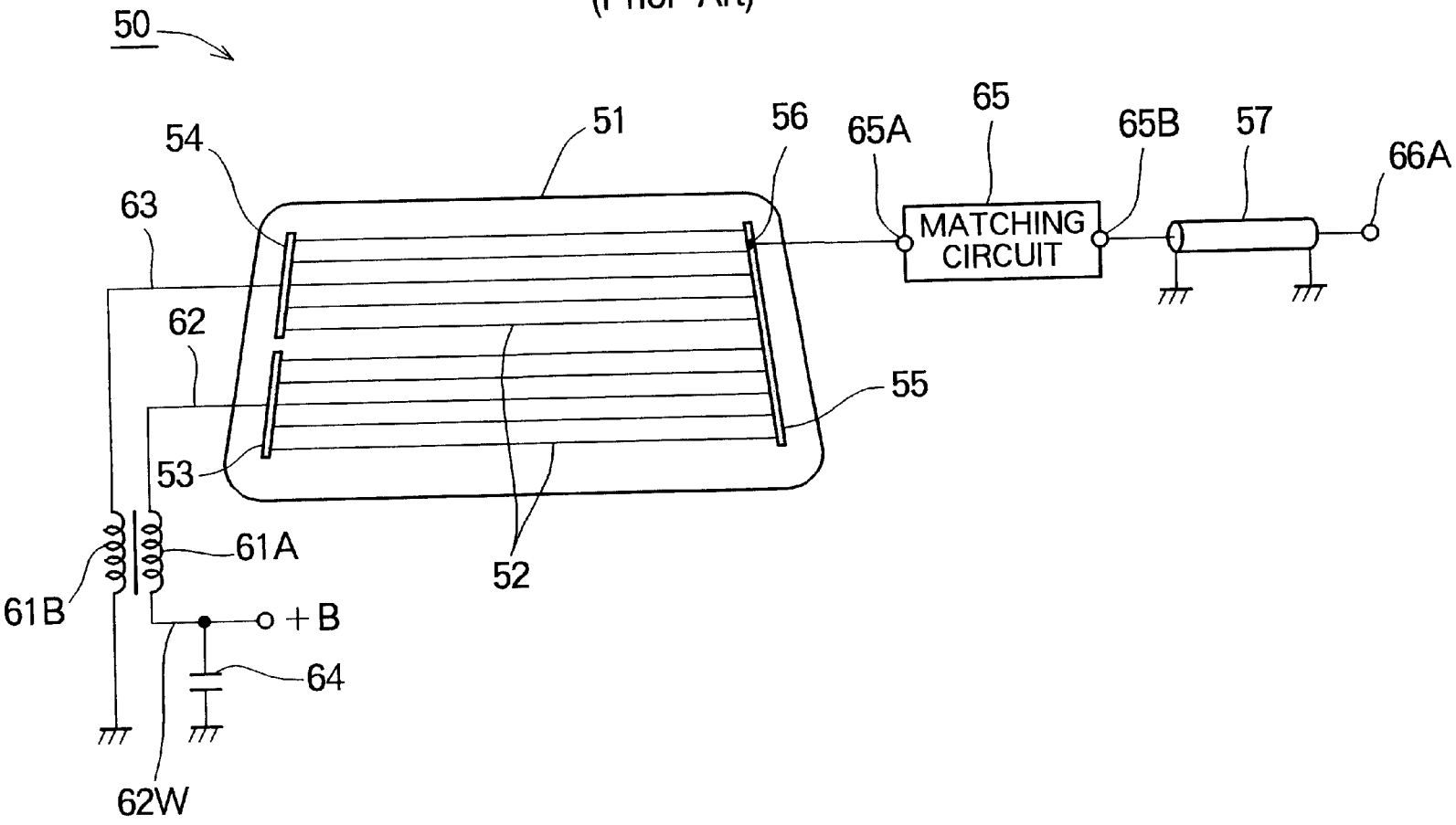
FIG. 12 (Prior Art)
FIG. 12 is a schematic view illustrating the general arrangement of a conventional window glass antenna system.
Figure 13:
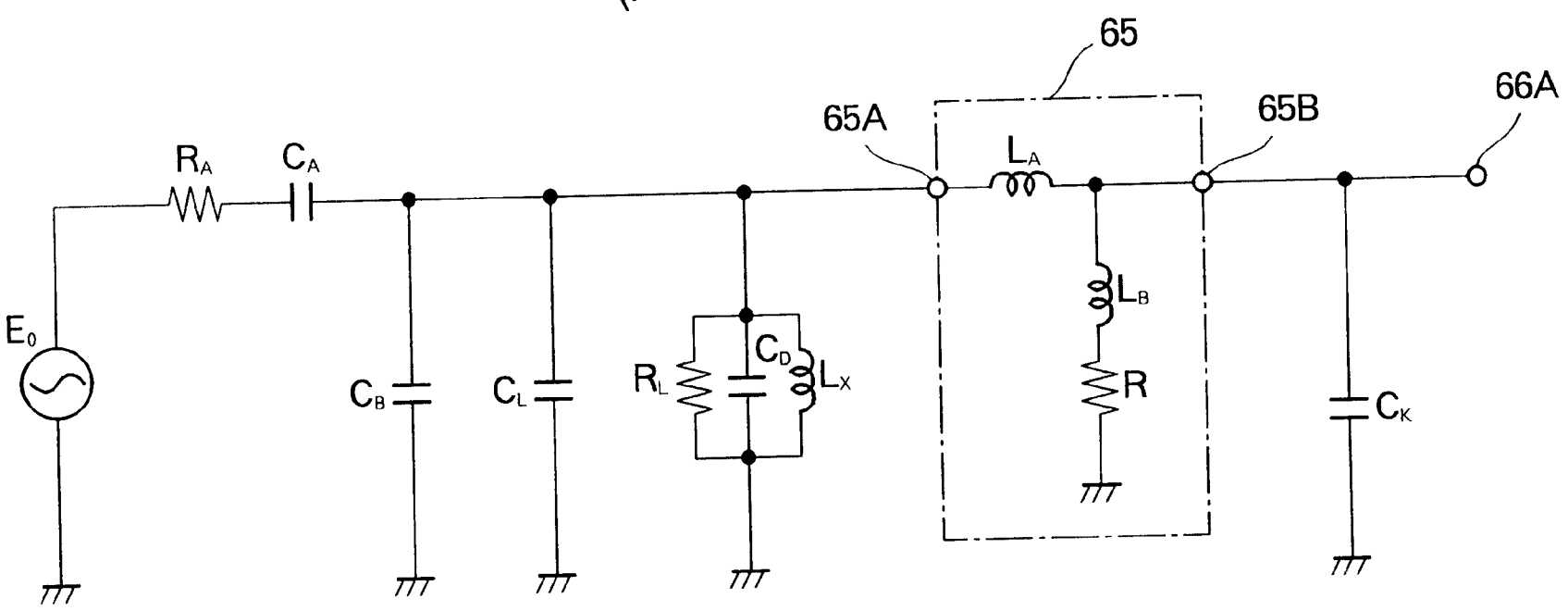
FIG. 13 (Prior Art)
FIG. 13 is a circuit diagram of an equivalent circuit of the conventional window glass antenna system.

FIG. 11 shows noise level characteristics (C1=220 pF) of the radio receiver input terminal in a case where the impedance matching circuit of FIG. 2 is used.

As seen from FIG. 11, use of the impedance matching circuit (capacitor C1=220 pF) as shown in FIG. 2 achieves substantial attenuation (noise level-20 dBm) of the peak of the noise level in the vicinity of the frequency of 200 KHz as shown in FIG. 10.

It may be appreciated from the characteristics of FIG. 10 and FIG. 11 that the inductor L1 of the impedance matching circuit 35 is desirably set at 100 $\mu$H and the capacitor C1 at 220 pF.

As thus far explained in detail, the present invention resides in the window glass antenna system having the impedance matching circuit which is provided with the noise blocking capacitor, whereby AM frequency band noises from the heater patterns, which are designed to serve also as the AM antenna, can be reduced significantly without attenuating received signals of AM broadcast. As a result, AM broadcast radio reception of good S/N ratio is enabled.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A window glass antenna system comprising:

a heater pattern comprising at least one conductive element disposed on a pane of window glass for flowing a heat-generating current therethrough to defog the window glass pane and for receiving AM broadcast signals;

an impedance matching circuit disposed externally of the window glass pane and connected to the heater pattern, the impedance matching circuit being connectable during use of the window glass antenna system to a radio receiver for supplying the AM broadcast signals thereto;

an FM band antenna connected to the impedance matching circuit; and a noise-blocking capacitor disposed between the heater pattern and the impedance matching circuit for blocking induced noises in the AM frequency band;

wherein the impedance matching circuit comprises a first input terminal for receiving AM broadcast signals from the at least one conductive element, a second input terminal for receiving FM signals from the FM band antenna, a first inductor for causing series resonance of AM broadcast signals output from the heater pattern, a second inductor for causing parallel resonance of the AM broadcast signals output from the heater pattern, a first output terminal short-circuited with the first input terminal for outputting AM broadcast signals, a second output terminal for outputting FM signals, a first circuit connected between the first and second input terminals and comprising the first inductor and a first resistor connected in parallel therewith across the first and second input terminals, the first circuit and the second input terminal being connected in series with the noise-blocking capacitor, a second circuit connected in parallel with the first circuit and comprising the second inductor and a second resistor connected in parallel therewith, the second inductor and second resistor each having a first electrode connected to the short-circuited first input terminal and first output terminal and each having a grounded second electrode, and a second capacitor connected in series with the noise-blocking capacitor and the second output terminal for blocking AM broadcast signals and passing FM signals so that only FM signals are output from the second output terminal.

2. A window glass antenna system according to claim 1; wherein the noise-blocking capacitor has a capacitance value within the range of 220 pF to 560 pF.

3. A window glass antenna system according to claim 1; further comprising a coaxial feeder cable connected to the impedance matching circuit and the radio receiver for supplying AM broadcast signals output by the impedance matching circuit to the radio receiver.

4. A window glass antenna system according to claim 1; wherein the heater pattern comprises a plurality of upper and lower conductive elements disposed on the window pane, a first bus bar commonly connecting respective first ends of the lower conductive elements, a second bus bar commonly connecting respective first ends of the upper conductive elements, a third bus bar commonly connecting respective second ends of the upper and lower conductive elements, a pair of first terminals for supplying the heat-generating current to the conductive elements to defog the window glass pane, and a second terminal from which AM broadcast signals received by the conductive elements are output to the impedance matching circuit.

5. A window glass antenna system according to claim 4; further comprising a pair of choke coils for supplying the heat-generating current to the conductive elements; a power source for supplying power to a first one of the choke coils to produce the heat-generating current; and a decoupling capacitor connected to the first choke coil to block noise induced by the power source noise from entering the conductive elements.

6. A window glass antenna system according to claim 5; wherein the choke coils have a high impedance to AM frequency signals so as to prevent signal loss.

7. A window glass antenna system according to claim 5; wherein the choke coils have an inductance value of about 1.4 $\mu$H.

8. A window glass antenna system according to claim 1; wherein the FM band antenna comprises at least one conductive element disposed on the window glass separate from the at least one conductive element comprising the heater pattern.

9. A window glass antenna system according to claim 1; wherein the first inductor has an inductance value of about 10 $\mu$H, the second inductor has an inductance value of about 680 $\mu$H, the first and second resistors have a resistance value of about 5.1 k$\Omega$, the noise-blocking capacitor has a capacitance value within the range of about 220 pF to 1000 pF, and the second capacitor has a capacitance value of about 22 pF.

10. A window glass antenna system according to claim 9; wherein the noise-blocking capacitor has a capacitance value within the range of about 220 pF to 560 pF.

11. A window glass antenna system according to claim 1; wherein the first inductor has an inductance value of about 3.9 $\mu$H, the second inductor has an inductance value of about 680 $\mu$H, the second resistor has a resistance value of about 1.2 k$\Omega$, the noise-blocking capacitor has a capacitance value of about 220 pF and the second capacitor has a capacitance value of about 100 pF.

12. A window glass antenna system comprising:

a heater pattern comprising at least one conductive element disposed on a pane of window glass for flowing a heat-generating current therethrough to defog the window glass pane and for receiving AM broadcast signals;

an impedance matching circuit disposed externally of the window class pane and connected to the heater pattern, the impedance matching circuit being connectable during use of the window glass antenna system to a radio receiver for supplying the AM broadcast signals thereto;

an FM band antenna connected to the impedance matching circuit; and a noise blocking capacitor disposed between the heater pattern and the impedance matching circuit for blocking induced noises in the AM frequency band;

wherein the impedance matching circuit comprises a first input terminal for receiving AM broadcast signals from the at least one conductive element, a second input terminal for receiving FM signals from the FM band antenna, a first output terminal short-circuited with the first input terminal for outputting AM broadcast signals, a second output terminal for outputting FM signals, a first inductor connected between the first and second input terminals for causing series resonance of AM broadcast signals output from the heater pattern, the first inductor and the second input terminal being connected in series with the noise-blocking capacitor, a parallel combination of a second inductor and a resistor connected in parallel with the first inductor, the second inductor and resistor each having an electrode connected to ground and the second inductor for causing parallel resonance of the AM broadcast signals output from the heater pattern, and a second capacitor connected in series with the noise-blocking capacitor and the second output terminal for blocking AM broadcast signals and passing FM signals so that only FM signals are output from the second output terminal.

13. A window glass antenna system according to claim 12; wherein the first inductor has an inductance value of about 3.9 $\mu$H, the second inductor has an inductance value of about 680 $\mu$H, the resistor has a resistance value of about 1.2 k$\Omega$, the noise-blocking capacitor has a capacitance value of about 220 pF and the second capacitor has a capacitance value of about 100 pF.

14. A window glass antenna system according to claim 12; wherein the noise-blocking capacitor has a capacitance value within the range of 220 pF to 560 pF.

15. A window glass antenna system according to claim 12; further comprising a coaxial feeder cable connected to the impedance matching circuit and the radio receiver for supplying AM broadcast signals output by the impedance matching circuit to the radio receiver.

16. A window glass antenna system according to claim 12; wherein the heater pattern comprises a plurality of upper and lower conductive elements disposed on the window pane, a first bus bar commonly connecting respective first ends of the lower conductive elements, a second bus bar commonly connecting respective first ends of the upper conductive elements, a third bus bar commonly connecting respective second ends of the upper and lower conductive elements, a pair of first terminals for supplying the heat-generating current to the conductive elements to defog the window glass pane, and a second terminal from which AM broadcast signals received by the conductive elements are output to the impedance matching circuit.

17. A window glass antenna system according to claim 16; further comprising a pair of choke coils for supplying the heat-generating current to the conductive elements; a power source for supplying power to a first one of the choke coils to produce the heat-generating current; and a decoupling capacitor connected to the first choke coil to block noise induced by the power source noise from entering the conductive elements.

18. A window glass antenna system according to claim 17; wherein the choke coils have a high impedance to AM frequency signals so as to prevent signal loss.

19. A window glass antenna system according to claim 17; wherein the choke coils have an inductance value of about 1.4 $\mu$H.

20. A window glass antenna system according to claim 12; wherein the FM band antenna comprises at least one conductive element disposed on the window glass separate from the at least one conductive element comprising the heater pattern.

21. A window glass antenna system according to claim 12; wherein the noise-blocking capacitor has a capacitance value within the range of about 220 pF to 560 pF.

* * * * *